US006339974B1

(12) United States Patent
Kotschner et al.

(10) Patent No.: US 6,339,974 B1
(45) Date of Patent: Jan. 22, 2002

(54) CARPENTER HAMMER

(76) Inventors: Josef Kotschner, 6-9196 Tronson, Rd., Vernon, B.C. (CA), V1H 1E8; Ralph-Paul Kotschner, 8203 Westcal Rd., Vernon, B.C. (CA), V1B 1Y4

( * ) Notice: Subject to any disclaimer, the term of this patent is extended or adjusted under 35 U.S.C. 154(b) by 169 days.

(21) Appl. No.: 09/039,474

(22) Filed: Mar. 16, 1998

(51) Int. Cl.[7] ..... B25D 1/00
(52) U.S. Cl. ..... 81/24; 81/23
(58) Field of Search ..... 81/24, 23

(56) References Cited

U.S. PATENT DOCUMENTS 611,973 A * 10/1898 Newbrough ..... 81/24
1,110,188 A 9/1914 Currie
2,597,816 A 5/1952 Kurkjian
4,448,230 A 5/1984 Reed
4,465,115 A * 8/1984 Palomera ..... 145/30

* cited by examiner

*Primary Examiner*—Joseph J. Hail, III
*Assistant Examiner*—David Shanley
(74) *Attorney, Agent, or Firm*—Robert Halper

(57) ABSTRACT

A hammerhead made of tool steel and having in combination a pair of asymmetric claws and a magnetic nail holder, the holder being in the form of a T-shaped notch and a permanent magnet having a very high field intensity as compared to the conventional permannet magnet.

3 Claims, 2 Drawing Sheets

CARPENTER HAMMER

FIELD OF INVENTION

This invention pertains to a Carpenter Hammer and in particular to a unique combination involving the claws and the shank.

BACKGROUND OF THE INVENTION

U.S. Pat. No. 611,793 teaches a combination tool that includes a hammer and a tong or vise. The hammer has a rounded head that includes a pair of claws, one of which terminates in a flat, sharp end and the other claw is pointed and extends beyond the end of the first claw. The sharp end is adapted to be forced under the head of a nail, spike or any other object to be moved. The sharp end can be forced into wood or under any other objects.

U.S. Pat. No. 1,110,188 is another round headed hammer where a slot that defines the claw extends diagonally of the head opening at one side thereof to provide relatively short and long members. The long member hasd a borad end that provides a cutting edge, the shorter member terminates rearwardly of the plane of the cutting edge so as not to interfere with material being cut.

U.S. Pat. No. 2,597,876 teaches a magnetic nail holding member. The hammer has a conventional shank, but has provided in its top surface a longitudinal nail receiving channel extending the length of the shank and midway of the sides. At the inner end of the channel is a groove for the head of the nail and a rear wall adjacent the groove. A permanent magnet is placed perpendicularly to the channel and is generally cylindrical. Its top surface is flush with the channel and is placed in a non- magnetic socket that surrounds the magnet except for the top surface. The socket acts as a shield to prevent dissipation of magnetic flux.

U. S. Pat. No. 4,448, 230 is another nail holding hammer. In the upper face of the shank and slightly recessed back from its striking face is a projection integral with the hammer head. The projection has a central bore for receiving the head of a nail Aligned with and at the rear of the bore is a magnet for holding the nail. The projection also includes a pair of nail shank support lugs, located laterally and toward the striking face of the shank. Between the lugs and the bore is a machined slot which receives the nail head. The head is then pushed back into the bore until it seat and abuts against the magnet.

U.S. Pat. No. 4,465,115 is also an example of a nail retaining means in a hammer head. The shank includes a longitudinal recess that extends from the face toward the central region of the hammerhead. The recess is designed for various diameter nails. An angular shaped pocket is also provided in the shank and includes a rear abutment wall in a plane perpendicular to the plane of the recess. The pocket is sized to receive the head of the nail. Between the abutment wall and the recess is a cavity that has a complimentary shape and size for a magnetic insert. The depth of the cavity is about equal or slightly less than that of the magnetic insert such that when the magnet is placed in the cavity, it is coplanar or slightly below the recess. When the magnet deteriorates, it can be manually removed and replaced. Alternatively the magnet can be secured to a bore in the head with a fastener. While not explicit the face of the hammer head appears to be scored. Additionally the hammerhead can be easily rerofitted into esisting hammerhead designs.

The art illustrated above two problems extant in the industry, namely the need for a hammer with specially shaped claws that can extract nails in inaccesible or hard to position areas. The art also recognized that it would be useful in many instances to secure a nail in a hammerhead instead of holding it between the fingers in order to nail the same, especially in locations beyond the normal reach of the user. Despite the existence of these two separate but related advances in hammer design, it seemed never to have occurred to those skilled in the art to combine these separate and distinct features in one integral unit; moreover, despite the statement in U.S. Pat. No. 4,465,115 that his magnet, unlike those of the prior art, is superior in retention of magnetic flux force, there is no explanation in the patent as to why this is so. In fact the claims define his magnet as a conventional natural magnet. Similarly there is no structure indicated that would make his hammerhead more easily retrofitted into existing hammerhead than any other of the cited patents.

It is therefore an object of this invention to design a carpenter hammer which combines the features of special claws and a magnetic device in the shank of a hammer.

It is still an object of this invention because of the combined features mentioned above is not only ergonomic but also economic as well.

It is also an object of this invention to utilize as a nail holding device a magnet that has far greater flux than any of the aforementioned patents.

SUMMARY OF THE INVENTION

The carpenter hammer of this invention is a drop forged tool steel device that includes a pair of claws, one of which is a shorter claw with a flat end and a longer pointed that allows bent nails to be easily removed especially in tight places. The striking face of the hammer is scored and beyond the region of the claws is a square configuration. The top of the hammer extending from the striking face contains a specially designed notch to seat a nail. A powerful magnet is embedded just below the notch to contain the nail while it is being driven into a desired object.

DETAILED DESCRIPTION OF THE INVENTION

Figure 1:
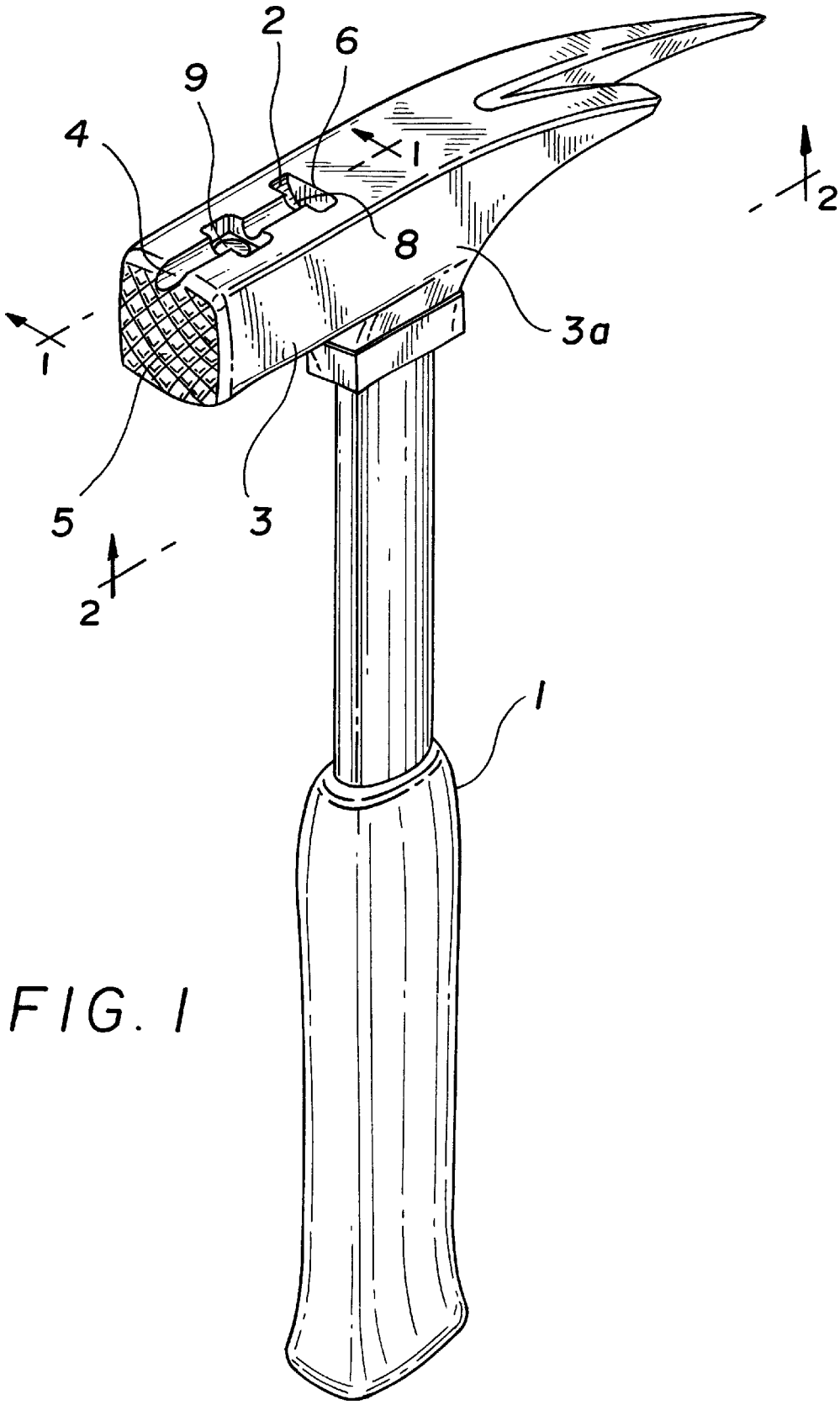
FIG. 1 is an isometric view of the hammer.
Figure 2:
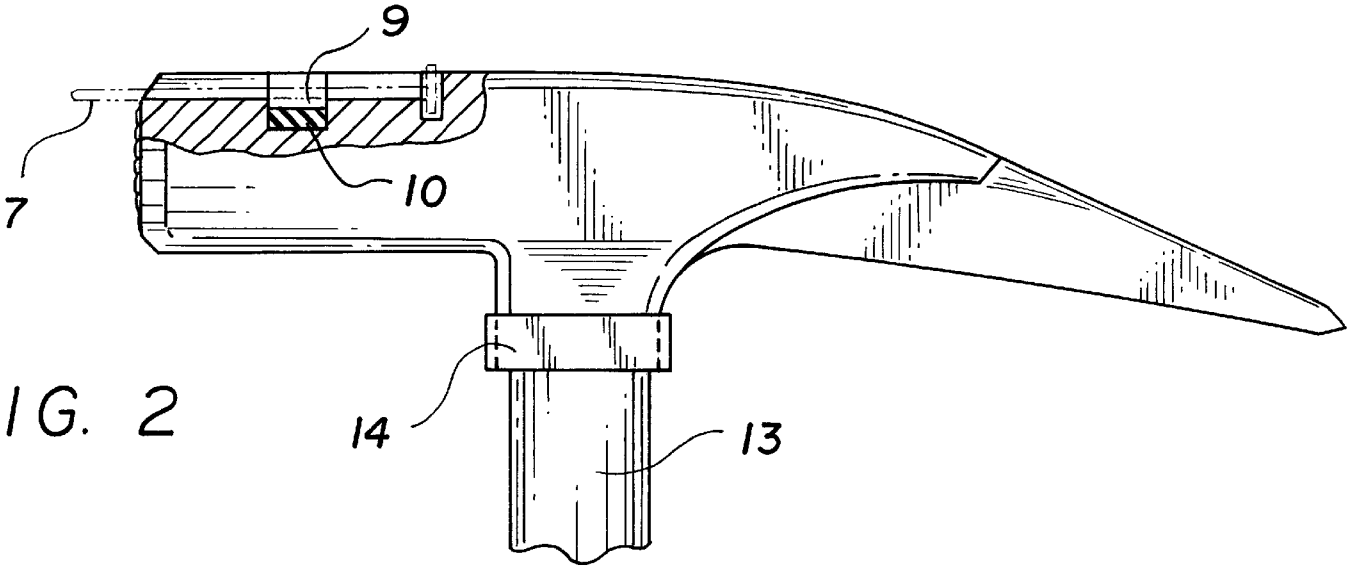
FIG. 2 is a sectional view taken on line 1—1 of FIG. 1.
Figure 3:
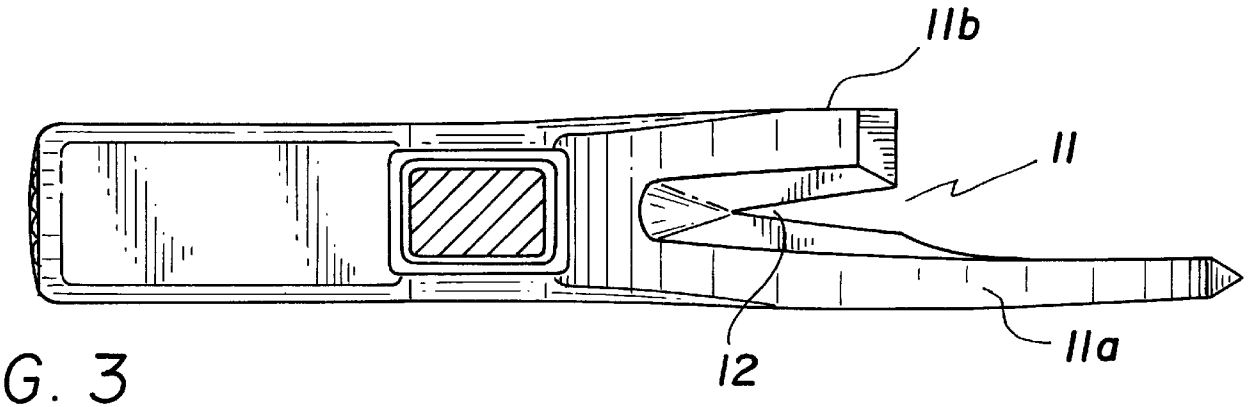
FIG. 3 is a plan view taken on line 2—2 of FIG. 1

FIG. 1 shows a hammer 1 with a square head having a T-shaped notch 2 in the top of the shank 3 midway of its sides 3*a*. The notch portion 4, that is in a plane parallel to the top surface of the shank is semicircular and starts from a scored face 5, extending inwardly to such a distance as to accommodate the different size nails. The notch portion terminates in a transverse section 6 that is somewhat greater in depth than the notch to allow for the head of a nail 7. The head of the nail abuts firmly against the wall 8 of the shank adjacent the transverse section while the shank of the nail is firmly aligned in the notch. In the center of the length of the notch and below thereof is a cavity 9 wider than the notch and circular in shape. A disk like permanent magnet 10 is placed within this cavity so that its upper surface is about flush with lower surface of the nail. The magnet preferably used is known by the ™ "Magnequench" and is an alloy of neodymium, iron and boron. These elements are poured in a molten state into a chilled rotating wheel that produces flakes that are bonded with an epoxy resin, and are either crushed in a press to shape or subjected to a plastic deformation which causes the magnetic crystals to align in the direction of the deforming pressure. These so-called MQ3 magnets develop an energy product of 45 MGOe, approximately 10 times the magnetic field of conventional permanent magnets. The energy product is a product of B×H where B equals magnetic induction and H equals magnetizing force. The maximum energy product is defined as the point on a demagnetizing curve where the product of B×H is a maximum and the required volume of magnetic material necessary to project a given energy into its surroundings is a minimum. MGOe represents a million gauss oersteds. (See http://www.magnetsales.com/materials.html). On the side of the hammerhead opposite the striking face are a a pair of assymetric claws 11, wherein claw 11*a* is a longer curved, pointed claw, whereas claw 11*b* is a shorter claw having a flat end and whose bottom surface as seen in FIG. 3 has a far smaller area than its top surface. The result is a bevel groove 12 between the straight claw and the pointed claw. The hammerhead is generally of the drop-forged, tool steel type although wooden hammers can also be used. A handle 13, attached to the head, is enclosed in a protection ring 14 to provide a more secure connection between the head and handle and to prevent damage to the head on impact.

In summation, starting a nail in a corner, for example is simplified using the notch and its associated magnet, while using the assymetric claws in the case of a bent nail, makes the task much easier. The scored face and square head provides an improved impact surface than the conventional round head hammer with the smooth face.

The invention, as it has been conceived, is susceptible to many modifications and variations as would be obvious to one skilled in the art without departing from the scope of the invention.

We claim:

1. A hammerhead having in combination a pair of asymmetric claws at one end and a shank portion having a magnetic nail holder;

a) said claws having a longer pointed claw and a shorter claw having a flat end, said shorter claw having a smaller surface area on its bottom, said claws defining a beveled groove between them, b) said shank portion being square shaped, having a scored face and a T- shaped notch with a notch portion extending from said face of said shank portion rearwardly thereof for such a distance as to accommodate different size nails, said notch portion terminating in a transverse section having a greater depth than said notch portion to accommodate a head of a nail, said head abutting against a wall of said shank and a length of said nail being firmly aligned in said notch, a cavity wider than said notch and located about midway of said face and said transverse section and below said notch, a permanent magnet inserted and secured in said cavity without a fastener, said magnet having a high energy product expressed as Mega Gauss Oersteds (MGOe) and an upper surface that is about flush with a lower surface of said notch, c) said hammerhead being attached to a handle and a protection ring surrounding said handle and said head at the point of attachment, d) said magnetic holder enabling the starting of a nail that is not within arm reach of a user and said asymmetric claws allowing easy access for removal of bent nails in tight places with the longer claw enabling pickup of heavy pieces of material.

2. A hammer head as in claim 1 wherein said permanent magnet is in the shape of a disk and said cavity conforms to said shape, and said magnet has ten times the magnetic field intensity of conventional permanent magnets.

3. A hammer head as in claim 1 wherein said head is of the drop-forged tool steel type.

* * * * *